United States Patent [19]

Munakata

[11] 4,367,001

[45] Jan. 4, 1983

[54] MULTIFUNCTION CONCENTRIC PLUG

[75] Inventor: Yoshitaka Munakata, Chiba, Japan

[73] Assignee: Sony Corporation, Tokyo, Japan

[21] Appl. No.: 188,521

[22] Filed: Sep. 18, 1980

[30] Foreign Application Priority Data

Oct. 5, 1979 [JP] Japan ..... 54-138676

[51] Int. Cl.[3] ..... H01R 11/02

[52] U.S. Cl. ..... 339/31 R; 339/153

[58] Field of Search ..... 339/31–33, 339/153, 154, 182, 183

[56] References Cited

U.S. PATENT DOCUMENTS

| | | | |
|---|---|---|---|
| 2,054,465 | 9/1936 | Ouellet | 339/153 |
| 2,825,882 | 3/1958 | Mitchell | 339/183 |
| 3,058,089 | 10/1962 | Seido | 339/31 R |
| 3,254,323 | 5/1966 | Wyse | 339/183 |

*Primary Examiner*—Joseph H. McGlynn

*Attorney, Agent, or Firm*—Hill, Van Santen, Steadman, Chiara & Simpson

[57] ABSTRACT

A multifunction concentric plug comprises a large-size concentric plug portion and a small-size concentric plug portion. When the portions are combined, a sleeve of relatively small-size concentric plug portion is arranged in a hollow of a sleeve of the large-size concentric plug portion so that the sleeve of the large-size concentric plug portion is aligned with the sleeve of the small-size concentric plug portion. The tip of the small-size concentric plug portion electrically contacts a core conductor of the large-size concentric plug portion. A combining means is provided in knobs of the large-size and small-size concentric plug portions whereby the large-size and small-size concentric plug portions can be securely combined with each other.

9 Claims, 6 Drawing Figures

1
5
9
10
2
7

5
4
6
8
9
3
13
17
12
21
20
7
14
10
19
15
18
16

5
4
6
9
10
7
3
16
12
13

MULTIFUNCTION CONCENTRIC PLUG

BACKGROUND OF THE INVENTION

1. Field of the Invention:

This invention relates to a concentric plug which is used for a citizen apparatus such as an accoustic apparatus and a television receiver, and more particularly to a multifunction concentric plug which is used both as a large-size concentric plug as well as a small-size concentric plug.

2. Description of the Prior Art:

Concentric plugs are classified as a large-size concentric plug (sleeve diameter 6.3 $\phi$), a small-size concentric plug (sleeve diameter 3.5 $\phi$) and a miniature concentric plug (sleeve diameter 2.5 $\phi$). When they are so designed that they are individually used, many kinds of models should be manufactured, stored and transported. This fact requires substantial additional cost.

A converting adapter 2 as shown in FIG. 1 has been proposed for reducing the manufacturing, storing and transporting cost. Referring to FIG. 1, a small-size concentric plug or miniature concentric plug 1 can be converted to a large-size concentric plug by the converting adapter 2. The converting adapter 2 is so-called a "plug-jack".

An interior of a knob 7 is constructed as a jack provided with two contacts in the converting adapter 2. A tip 10 of the small-size concentric plug 1 and a sleeve 9 thereof contact with the two contacts of the knob 7, respectively. Accordingly, the knob 7 of the converting adapter 2 requires a considerable length. The whole length of a complex concentric plug which is formed by the combination of the converting adapter 2 and small-size concentric plug 1 is quite large. It is very inconvenient to handle the complex concentric plug. The small-sized concentric plug 1 and the converting adapter 2 are combined with each other only by contact pressure or frictional force. The combination of the small-size concentric plug and converting adapter 2 often loosen in use, resulting in electric contact failure.

SUMMARY OF THE INVENTION

An object of this invention is to provide a multifunction concentric plug which has substantially the same size as a conventional large-size concentric plug and can be used both as a large-size concentric plug and a small-size concentric plug.

Another object of this invention is to provide a complex plug which does not bring about electric contact failure.

In accordance with an aspect of this invention, a complex concentric plug including a large-size concentric plug portion of a small-size concentric plug portion: the large-size concentric plug portion comprising (a) a sleeve having a hollow, (b) a core conductor, (c) a knob, and (d) combining means formed in the knob, and the small-size concentric plug portion comprising (e) another sleeve being inserted into the hollow of the large-size concentric plug portion so as to align with the sleeve of the latter, (f) a tip contacting the core conductor of the large-size concentric plug portion in the hollow of the latter, (g) another knob, and (h) another combining means formed in the other knob, whereby the large-size concentric plug portion and the small-size concentric plug portion are combined with each other by the combining means and the other combining means.

Various other objects, advantages and features of the present invention will become readily apparent from the ensuing detailed description, and the novel feature will be particularly pointed out in the appended claims.

DESCRIPTION OF THE PREFERRED EMBODIMENTS

One embodiment of this invention will now be described with reference to the drawings. The respective parts of a complex concentric plug according to this embodiment will be named under the regulation of the standard No. RC-6701 of the Japanese Electronic Mechanical Industry.

Figures 1, 2, 3:
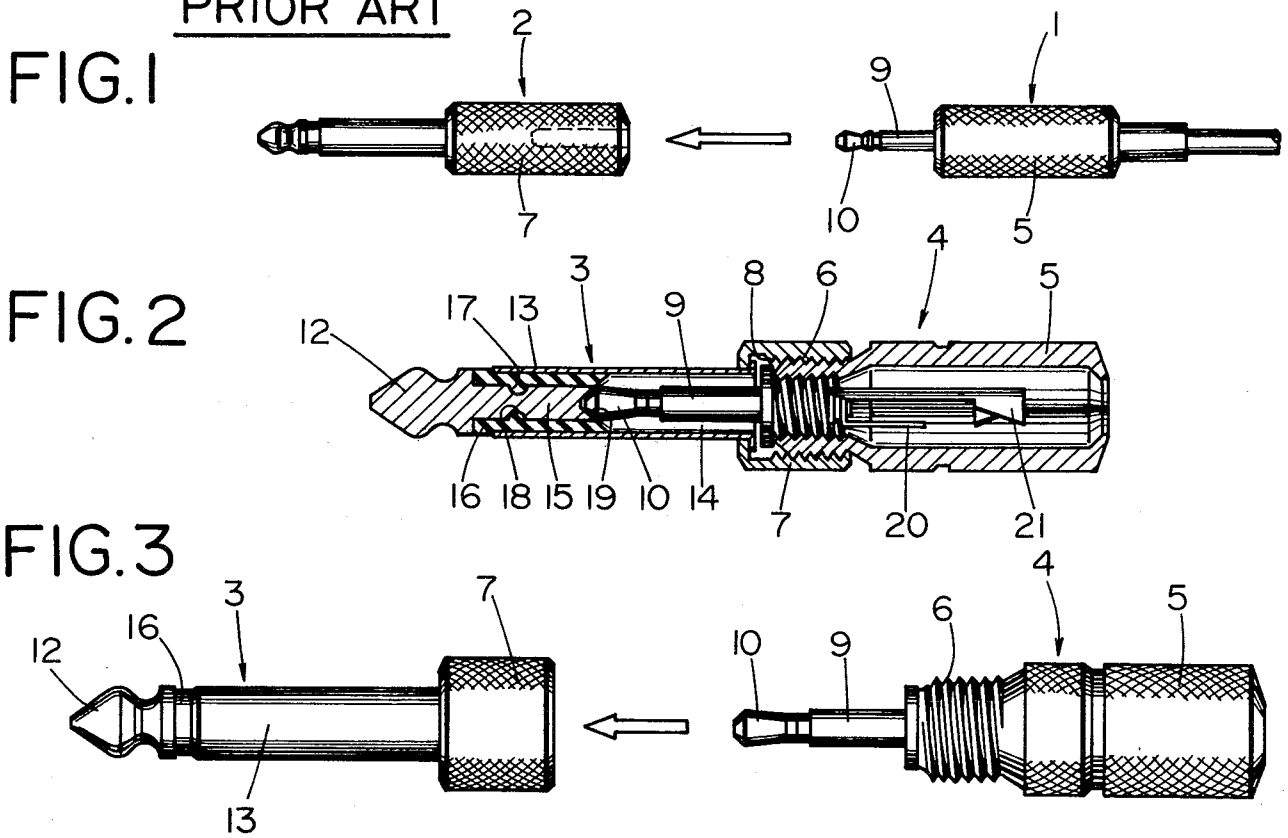
PRIOR ART FIG.1
FIG. 1 is a partly-broken side view of a conventional complex concentric plug in which there is shown the situation where a small-size concentric plug is converted to a large-size concentric plug by a convertng adapter.
FIG. 2 is a cross-sectional view of a complex concentric plug according to a first embodiment of the invention.
FIG. 3 is a partly-broken side view of the complex concentric plug in a separated condition.

FIG. 2 is a cross-sectional view of the complex concentric plug of one embodiment. FIG. 3 is a side view of the complex concentric plug of FIG. 2 in its separated condition. Referring to FIG. 3, the complex concentric plug consists of a large-size concentric portion 3 and a small-size concentric portion 4. In the small-size concentric plug portion 4, a threaded portion 6 is formed on the outer circumferential surface of the plug-side end of a metallic knob 5. In the large-size concentric plug portion 3, internally threaded portion 8 is formed on the inner circumferential surface of a metallic knob 7, to be engaged with the screw 6 of the small-size concentric plug portion 4. The small-size concentric plug portion 4 is screwed into the large-size concentric plug portion 3 to be combined with the latter, as shown in FIG. 2. In the combined condition the whole length of the complex concentric plug is nearly equal to, or substantially equal to that of the conventional large-size concentric plug.

A contact portion of the small-size concentric plug portion 4 consists of a sleeve 9 and a tip 10 combined with the sleeve 9, and it is received by a hollow region 14 of a sleeve 13 of the large-size concentric plug portion 3.

A tip 12 of the large-size concentric portion 3 extends as a core conductor 15 almost to the center of the sleeve 13. The remaining part of the sleeve 13 forms the hollow 14. An insulating collar 16 is fitted to the circumferential surface of the core conductor 15 by an inserting-mold method or a press-fitting method.

A recess 17 is formed in the circumferential surface of the core conductor 15. A rib projection 18 is formed in the inner circumferential surface of the insulating collar 16. The recess 17 is engaged with the rib projection 18 to prevent the tip 12 from falling out.

In the large-size concentric plug portion 3, the insulating collar 16 with the tip 12 is pressed into the sleeve 13. One end of the sleeve 13 is caulked to the knob 7 to be fixed to the latter. One end of the core conductor 15 is tapered to form a recess 19. When the small-size concentric plug portion 4 is screwed into the large-size concentric plug portion 3, the tip 10 of the small-size concentric plug portion 4 is engaged with the recess 19 of the core conductor 15, and it is pressed to the latter in the axial direction by function of the threaded portions 6 and 8. Thus, the tip 10 of the small-size plug portion 4 is brought into sure electrical contact with the core conductor 15 of the large-size concentric plug portion 3.

The jack formed in the conventional converting adapter 2 is not required in the large-size concentric plug portion 3 of this embodiment. Thus, the whole length of the complex concentric plug is reduced, and contact parts and spacers are not necessary, resulting in considerable decrease of the number of parts required for a complex concentric plug. The complex concentric plug is very reliable in electrical contact. There is not the inconvenience that the combination will loosen in use, or that the contact will become inferior as does the conventional complex concentric plug of FIG. 1.

The small-size concentric plug portion 4 is the same as the conventional small-size concentric plug except the screw 6. The tip 10 is connected through a not-shown core conductor to a terminal plate 20. The sleeve 13 of the large-size concentric plug portion 3 is electrically connected through the screws 6 and 8 of the knob 5 and 7 to the sleeve 9 of the small-size concentric plug portion 4. The sleeve 9 of the small-size concentric plug portion 4 is connected to a terminal plage 21.

Figure 4:
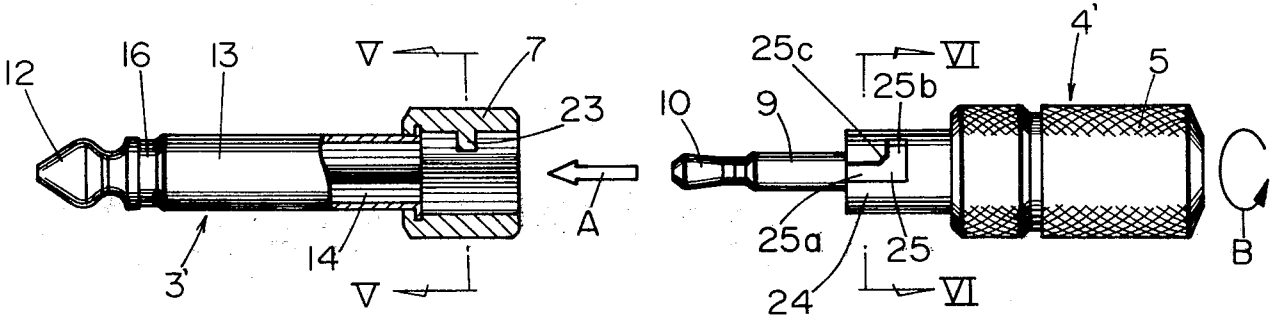
FIG 4 is a partly-broken side view of a complex concentric plug according to a second embodiment of this invention in a separated condition.
Figure 6:
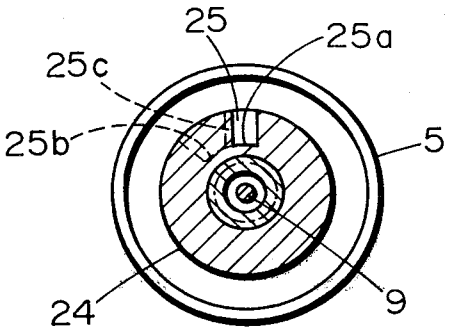
FIG. 6 is a cross-sectional view taken along the line VI—VI of FIG. 4.
Figure 5:
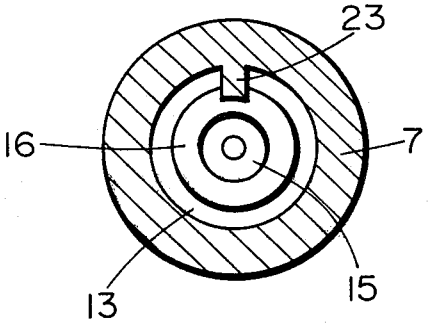
FIG. 5 is a cross-sectional view taken along the line V—V of FIG. 4.

FIG. 4 is a partly-broken side view of a complex concentric plug according to another embodiment of this invention in the separated condition. FIG. 5 is a cross-sectional view taken along the line V—V on FIG. 4. And FIG. 6 is a cross-sectional view taken along the line VI—VI on FIG. 4. In this embodiment, a key combination method is used for combining large-size and small-size concentric plug portions, while the screws 6 and 8 are used for the same purpose in the first embodiment.

As shown in FIG. 4 and FIG. 5, a projection 23 is formed in the inside wall of the knob 7 in a large-size concentric plug portion 3'. And as shown in FIg. 4 and FIG. 6, an L-shaped recess 25 is formed in the outer circumferential surface of the end portion of the knob 5 in a small-size concentric plug portion 4'. The L-shaped recess 25 consists of an axial part **25*a* and a peripheral part 25*b*. A boundary between the axial part 25*a* and the peripheral part 25*b* is tapered as indicated by a reference numberal 25*c***.

In the combining operation of the large-size and small-size concentric plug portions 3' and 4', the small-size concentric plug portion 4' is so inserted into the large-size concentric plug portion 3' in the direction shown by an arrow A that the projection 23 is led into the axial part **25*a* of the L-shaped recess 25. And the small-size concentric plug portion 4' is rotated in the direction shown by an arrow B. The projection 23 clears the taper portion 25*c* of the recess 25, and engages with the peripheral part 25*b* of the recess 25. In the engaged condition, the projection 23 and the peripheral part 25*b* of the recess 25 are pushed to each other in the axial direction. Thus, the tip 10 of the small-size concentric plug portion 4 is brought into close contact with the core conductor 15 of the large-size concentric plug portion 3. Accordingly, a good electric connection is obtained between the large-size and small-size concentric plug portions 3 and 4. Unless the small-size concentric plug portion 4 is rotated in the direction opposite to the direction shown by the arrow B, the large-size and small-size concentric plug portions 3 and 4** cannot be separated from each other.

The recess 25 may be formed in the large-size concentric plug portion 3', not in the small-size concentric plug portion 4', and the projection 23 may be formed in the small-size concentric plug portion 4', not in the large-size concentric plug portion 3'. Or another means may be used for combining the large-size and small-size concentric plug portions 3' and 4'. For example, in this other means, a tapped hole is formed in the knob 7 of the large-size concentric plug portion 3', in the radial direction of the knob 7, and a screw is engaged with the tapped hole for combining the large-size and small-size concentric plug portions 3' and 4'.

In this invention, as above described, the sleeve of the small-size concentric plug portion is arranged in the hollow of the sleeve of the large-size concentric plug portion so that the sleeve of the large-size concentric plug portion is aligned with the sleeve of the small-size concentric plug portion. The tip of the small-size concentric plug portion electrically contacts with the core conductor of the large-size concentric plug portion. The combining means is provided in the knobs of the large-size and small-size concentric plug portions, whereby the large-size and small-size concentric plug portions can be securely combined with each other. Since no jack is provided in the large-size concentric plug portion, the complex concentric plug of this invention is very simple in construction. When the large-size and small-size concentric plug portions are combined with each other, the whole length of the complex concentric plug is not unnecessarily increased, and it is nearly equal to the whole length of the conventional large-size concentric plug. Further, the complex concentric plug of this invention can be easily handled. The combination of the larger-size and small-sie concentric plug portions is secure. The electric contact does not become inferior in use.

With this invention is illustrated with specific embodiments, it will be recognized by those skilled in the art that modifications may be made therein without departing from the true scope of the invention as defined by the following claims.

I claim as my invention:

1. In a prior art multifunction concentric plug assembly formed of a large-size concentric plug portion and a small-size concentric plug portion, each of said plug portions having a knob, sleeve extending from the knob, and a tip conductor at an end of the sleeve opposite the knob the small-size plug having a small sleeve and the large-size plug having a large sleeve, and wherein the small-size plug portion plugs into a receiving aperture of the large-size plug portion to form an assembly of given overall length, wherein the improvement comprises:

the sleeve of the large-size plug portion being hollow and the tip conductor having a portion positioned in and at the end of said hollow so as to form a free space in said hollow defined by an end of said tip conductor within the sleeve and walls of the hollow said free space extending to an end of said sleeve at the knob;

the substantially entire sleeve of the small-size plug portion being received within said free space and the tip of the small-size plug portion being in electrical contact with the large-size plug tip conductor when assembled with the large-size plug portion;

a first combining means in one of said knob and a second combining means formed in the other of said knob, said large-size plug portion and small-size plug portion being combined with each other by said first and second combining means; and a length of the combined sleeve assembly being substantially shorter than said given length of assembled prior art large-size and small-size plug portions.

2. An assembly according to claim 1 in which said first combining means is a projection formed in the inside wall of said knob, and said second combining means is an L-shaped recess formed in the outer circumferential surface of said other knob, said projection and L-shaped recess being engageable with each other.

3. An assembly according to claim 1 in which said first combining means is an L-shaped recess formed in the inside wall of said knob, and said second combining means is a projection formed in the outer circumferential surface of said other knob, said projection and L-shaped recess being engageable with each other.

4. An assembly according to claim 1 in which said tip of the small-size concentric plug portion of said sleeve thereof are received in said hollow of the large-size concentric plug portion.

5. An assemby according to claim 1 wherein the tip conductor of the large-size plug portion is mounted in an insulating collar at the end of the sleeve and has an end surface in direct mechanical and electrical contact with a tip of the tip conductor of the small-size plug portion.

6. An assembly according to claim 1 wherein the sleeve of each of the plug portions is cylindrical.

7. An assembly according to claim 6 wherein the tip conductor of the small-size plug portion abuts against the end of the tip conductor of the large-size plug portion within the free space.

8. An assembly according to claim 1 in which said first and second combining means are screw engageable with each other.

9. An assembly according to claim 8 in which said knobs are made of metal.

* * * * *